US009581960B2

(12) United States Patent
Hashimoto et al.

(10) Patent No.: US 9,581,960 B2
(45) Date of Patent: Feb. 28, 2017

(54) CARTRIDGE PROVIDED WITH COIL-SHAPED ELECTRODE MEMBER

(71) Applicant: Brother Kogyo Kabushiki Kaisha, Nagoya-shi, Aichi-ken (JP)

(72) Inventors: Junichi Hashimoto, Toyohashi (JP); Isao Kishi, Nagoya (JP); Shota Shinoya, Nagoya (JP); Koji Abe, Nagoya (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/297,710

(22) Filed: Jun. 6, 2014

(65) Prior Publication Data

US 2014/0363189 A1 Dec. 11, 2014

(30) Foreign Application Priority Data

Jun. 7, 2013 (JP) ..... 2013-121023

(51) Int. Cl.
*G03G 21/18* (2006.01)

(52) U.S. Cl.
CPC . *G03G 21/1867* (2013.01); *G03G 2221/1684* (2013.01)

(58) Field of Classification Search
CPC ..... G03G 21/1867; G03G 2221/166; G03G 2221/1684; G03G 15/02; G03G 15/80; G03G 21/1652
USPC ..... 399/90, 37, 111
See application file for complete search history.

(56) References Cited

U.S. PATENT DOCUMENTS

| | | | | |
|---|---|---|---|---|
| 7,079,783 | B2 | 7/2006 | Yokoi | |
| 7,421,225 | B2 | 9/2008 | Yokoi | |
| 7,773,905 | B2 | 8/2010 | Kuruma | |
| 7,978,997 | B2 | 7/2011 | Tokuda | |
| 8,038,483 | B2 | 10/2011 | Souda | |
| 8,583,006 | B2 | 11/2013 | Murayama et al. | |
| 2004/0028424 | A1 | 2/2004 | Yokoi | |
| 2006/0291893 | A1* | 12/2006 | Yano | 399/90 |
| 2007/0059018 | A1 | 3/2007 | Tokuda | |
| 2007/0077083 | A1 | 4/2007 | Yokoi | |

(Continued)

FOREIGN PATENT DOCUMENTS

| | | | |
|---|---|---|---|
| CN | 202494868 | U | 10/2012 |
| JP | 11-249362 | A | 9/1999 |

(Continued)

OTHER PUBLICATIONS

Jan. 10, 2017—(JP) Office Action—App 2013-121023, Eng Tran.

*Primary Examiner* — Gregory H Curran
(74) *Attorney, Agent, or Firm* — Banner & Witcoff, Ltd.

(57) ABSTRACT

A cartridge includes: a rotation body; and an electrode member. The electrode member is configured to supply the rotation body with electric power from an external electrode provided outside of the cartridge. The electrode member includes: a contact portion; and an urging portion. The contact portion is configured to be contacted by the external electrode. The urging portion is in a shape of a coil formed by winding a wire rod and configured to urge the contact portion toward the external electrode such that the contact portion is pivotally moved about the urging portion.

18 Claims, 9 Drawing Sheets

(56) References Cited

U.S. PATENT DOCUMENTS

| | | | | |
|---|---|---|---|---|
| 2008/0031656 | A1* | 2/2008 | Okabe | G03G 21/1871 399/241 |
| 2008/0159773 | A1 | 7/2008 | Murayama et al. | |
| 2008/0279579 | A1 | 11/2008 | Kuruma | |
| 2009/0169251 | A1* | 7/2009 | Itabashi | 399/115 |
| 2010/0080613 | A1* | 4/2010 | Itabashi | 399/111 |
| 2011/0065336 | A1* | 3/2011 | Souda | 439/824 |
| 2011/0206407 | A1 | 8/2011 | Mushika et al. | |
| 2012/0177403 | A1 | 7/2012 | Murayama et al. | |
| 2014/0079430 | A1 | 3/2014 | Mushika et al. | |

FOREIGN PATENT DOCUMENTS

| | | | |
|---|---|---|---|
| JP | 2004-077565 | A | 3/2004 |
| JP | 2007-079284 | A | 3/2007 |
| JP | 2008-165025 | A | 7/2008 |
| JP | 2008-276117 | A | 11/2008 |
| JP | 2011-064925 | A | 3/2011 |
| JP | 2011-175034 | A | 9/2011 |
| JP | 2012-068683 | A | 4/2012 |
| JP | 2012-234190 | A | 11/2012 |

* cited by examiner

13

CARTRIDGE PROVIDED WITH COIL-SHAPED ELECTRODE MEMBER

CROSS REFERENCE TO RELATED APPLICATION

This application claims priority from Japanese Patent Application No. 2013-121023 filed Jun. 7, 2013. The entire content of the priority application is incorporated herein by reference.

TECHNICAL FIELD

The present invention relates to a cartridge used in an image forming apparatus employing an electrophotographic system.

BACKGROUND

There is known, as an image forming apparatus, a printer detachably provided with a cartridge having a developing roller.

Further, there is known, as a cartridge detachably mounted to such a printer, a developing cartridge provided with an electrically-conductive member electrically connected to a contact portion provided in a main casing in order to apply developing bias to a developing roller.

Such a developing cartridge is inserted into the main casing to bring the electrically-conductive member into pressure contact with the contact portion by its resilient force to thereby connect the electrically-conductive member and the contact portion.

SUMMARY

However, the above developing cartridge uses, as the electrically-conductive member, a leaf spring formed of metal or electrically-conductive resin. The leaf spring is excellent in assembling workability with respect to the developing cartridge, resulting in high stability in attitude of the electrically-conductive member. On the other hand, the leaf spring has a complex shape to result in high production cost. Further, a high spring constant of the leaf spring may bring about a large change in a load when the leaf spring contacts the contact portion at a position displaced from a predetermined contact position.

In view of the foregoing, it is an object of the present invention to provide a cartridge capable of reliably supply electric power to a rotation body while reducing its production cost.

In order to attain the above and other objects, the present invention provides a cartridge that may include: a rotation body; and an electrode member. The electrode member may be configured to supply the rotation body with electric power from an external electrode provided outside of the cartridge. The electrode member may include: a contact portion; and an urging portion. The contact portion may be configured to be contacted with the external electrode. The urging portion may be in a shape of a coil formed by winding a wire rod and configured to urge the contact portion toward the external electrode such that the contact portion is pivotally moved about the urging portion.

According to another aspect, the present invention provides a cartridge that may include: a rotation body; an engagement portion; and an electrode member. The electrode member may be configured to supply the rotation body with electric power from an external electrode provided outside of the cartridge. The electrode member may include: an urging portion; a connecting portion; and a first arm portion. The urging portion may be in a shape of a coil formed by winding a wire rod. The wire rod may constitute the urging portion having one end and another end. The connecting portion may extend from the one end of the wire rod constituting the urging portion and include a contact portion configured to be contacted with the external electrode. The first arm portion may extend from the other end of the wire rod constituting the urging portion. The first arm portion may be configured to be engaged with the engagement portion.

DETAILED DESCRIPTION

Figure 1:
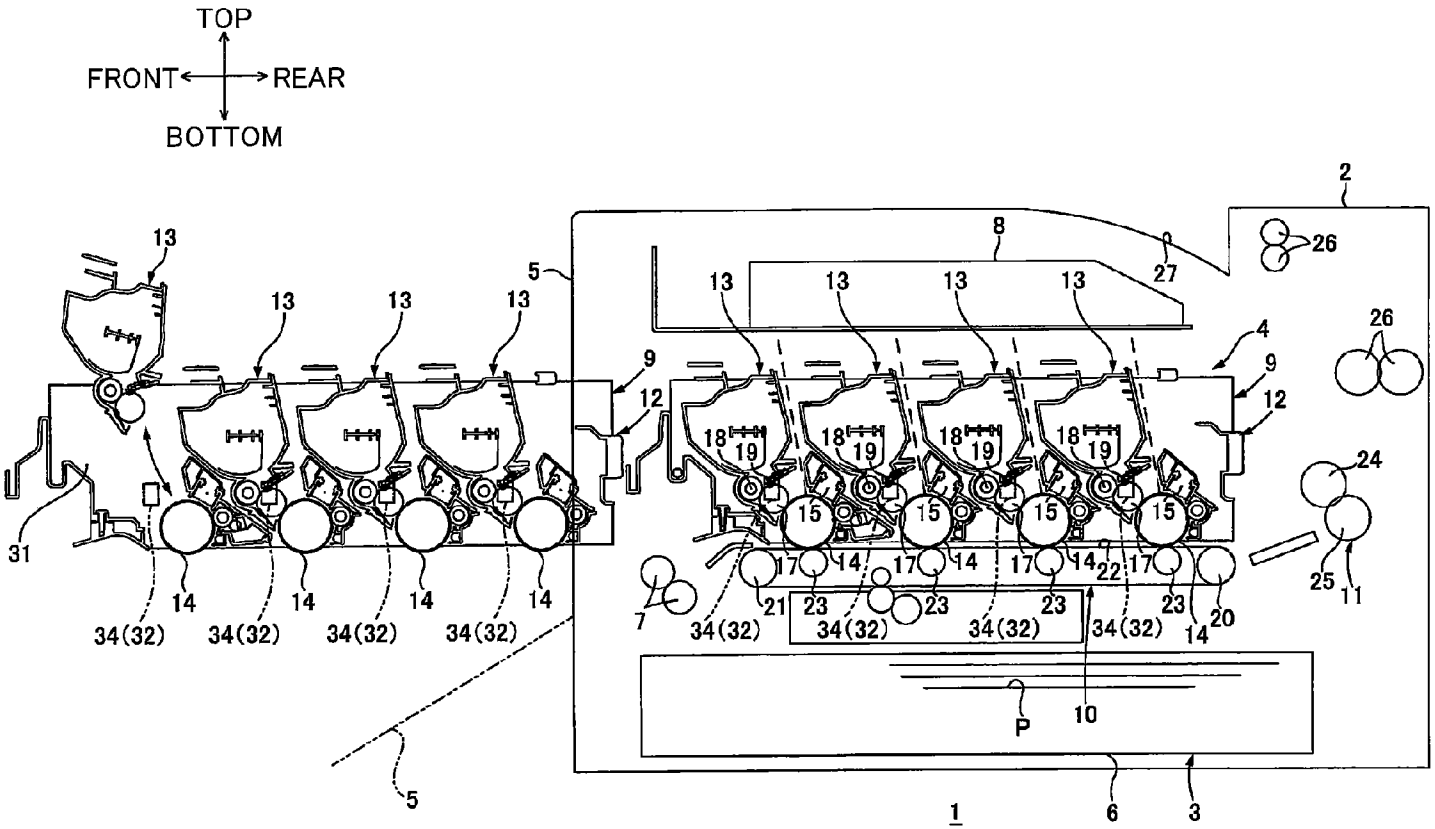
FIG. 1 is a central cross-sectional view of a printer provided with a developing cartridge according to one embodiment of the present invention.

A printer provided with a cartridge according to one embodiment of the present invention will be described with reference to FIGS. 1 through 9B, wherein like parts and components are designated by the same reference numerals to avoid duplicating description.

1. Overall Structure of Printer

As illustrated in FIG. 1, the printer 1 as an example of an image forming apparatus is a direct tandem-type color laser printer. The printer 1 includes a main casing 2, and, also includes, within the main casing 2, a sheet supply unit 3 for supplying a sheet of paper P, and an image forming unit 4 for forming an image on the sheet P supplied from the sheet supply unit 3.

Hereinafter, when referring to directions in relation to the printer 1, a vertical direction (up-down direction) thereof is defined in a state where the printer 1 is disposed in an orientation in which it is intended to be used, that is, the printer 1 is placed horizontally. More specifically, in FIG. 1, a left side and a right side are a front side and a rear side, respectively. Further, in FIG. 1, a top side and a bottom side are a top side and a bottom side, respectively. Further, a left side and a right side of the printer 1 will be based on the perspective of a user facing the front of the printer 1. Hence, in FIG. 1, a far side and a near side are a left side and a right side, respectively.

(1) Main Casing

The main casing 2 has a substantially box-like shape. The main casing 2 is provided with a front cover 5.

The front cover 5 is provided at a front wall of the main casing 2. The front cover 5 is pivotally movable about a lower end portion thereof to open and close an opening formed in the front wall. When the front cover 5 is open, a process unit 9 (described later) can be attached to and detached from the main casing 2 through the opening.

(2) Sheet Supplying Unit

The sheet supply unit 3 includes a sheet supply tray 6 and a pair of registration rollers 7.

The sheet supply tray 6 is disposed in a lower portion of the main casing 2. The sheet supply tray 6 accommodates the sheets P therein.

The registration rollers 7 are disposed above a front portion of the sheet supply tray 6. The registration rollers 7 serve to feed the sheet P toward the image forming unit 4.

(3) Image Forming Unit

The image forming unit 4 includes a scanner unit 8, the process unit 9, a transfer unit 10, and a fixing unit 11.

(3-1) Scanner Unit

The scanner unit 8 is disposed in an upper portion of the main casing 2. As denoted by dashed lines, the scanner unit 8 emits laser beams toward four photosensitive drums 14 (described later) based on image data to expose the photosensitive drums 14.

(3-2) Process Unit

The process unit 9 is disposed below the scanner unit 8 and above the transfer unit 10. The process unit 9 includes a process frame 12 and a plurality of (four in the embodiment) developing cartridges 13 as an example of a cartridge. The process frame 12 is slidingly movable in a front-rear direction, thereby being mounted in and withdrawn from the main casing 2.

The process frame 12 includes a plurality of (four in the embodiment) photosensitive drums 14 and a plurality of (four in the embodiment) scorotron chargers 15.

The four photosensitive drums 14 are arranged juxtaposed with each other and spaced apart from each other in the front-rear direction. The four photosensitive drums 14 each have a substantially cylindrical shape that is elongated in a left-right direction.

The four scorotron chargers 15 are each disposed diagonally above and rearward of the corresponding photosensitive drum 14 and spaced apart therefrom.

The four developing cartridges 13 are provided in one-to-one correspondence with the four photosensitive drums 14. The four developing cartridges 13 are each disposed diagonally above and frontward of the corresponding photosensitive drum 14. That is, the four developing cartridges 13 are arranged juxtaposed with each other in the front-rear direction. The four developing cartridges 13 are detachably supported to the process frame 12.

Each developing cartridge 13 includes a developing roller 17 as an example of a rotation body, a supply roller 18 as an example of a rotation body, and a layer thickness regulation blade 19.

As described later in detail, the developing roller 17 is rotatably supported at a lower end portion of the developing cartridge 13 so as to be exposed rearward. The developing roller 17 contacts the photosensitive drum 14 from an upper-front side thereof. The developing roller 17 includes a developing roller shaft 54 (FIG. 2) as an example of a rotation shaft. The developing roller shaft 54 extends in the left-right direction as an example of an extending direction. In other words, the developing roller 17 has a rotation axis extending in the extending direction.

The supply roller 18 contacts the developing roller 17 from an upper-front side thereof. The supply roller 18 includes a supply roller shaft 55 as an example of a rotation shaft. The supply roller shaft 55 extends in the left-right direction. In other words, the supply roller 18 has a rotation axis extending in the extending direction.

Note that the term "rotation shaft" implies a single rotation shaft extending through a body portion of the rotation body as well as two separate shafts each protruding outward from an axial end of the body portion of the rotation body. As long as the rotation body rotates about the rotation shaft, the shape and configuration of the rotation shaft is not limited to these.

The layer thickness regulation blade 19 contacts the developing roller 17 from an upper side thereof.

Each developing cartridge 13 defines an internal space formed above the supply roller 18 and the layer thickness regulation blade 19 for accommodating toner therein.

(3-3) Transfer Unit

The transfer unit 10 is disposed above the sheet supply unit 3 and below the process unit 9. The transfer unit 10 includes a drive roller 20, a driven roller 21, a conveying belt 22, and a plurality of (four in the embodiment) transfer rollers 23.

The drive roller 20 and the driven roller 21 are disposed spaced apart from each other in the front-rear direction and face each other in the front-rear direction.

The conveying belt 22 is looped around the drive roller 20 and the driven roller 21, with an upper portion of the conveying belt 22 in contact with bottom sides of the four photosensitive drums 14.

The four transfer rollers 23 are provided in one-to-one correspondence with the four photosensitive drums 14.

(3-4) Fixing Unit

The fixing unit 11 is disposed rearward of the transfer unit 10. The fixing unit 11 includes a heating roller 24 and a pressure roller 25 that contacts a lower-rear side of the heating roller 24 with pressure.

(4) Image Forming Operation

When an image forming operation is performed, toner accommodated in each of the developing cartridges 13 is supplied onto the supply roller 18, and the rotating supply roller 18 supplies the toner onto the developing roller 17 while the toner is tribo-charged between the supply roller 18 and the developing roller 17.

The layer thickness regulation blade 19 regulates the thickness of the toner supplied onto the developing roller 17 as the developing roller 17 rotates, maintaining the toner carried on the surface of the developing roller 17 at a thin uniform thickness.

In the meantime, the scorotron charger 15 applies a uniform charge to a surface of the corresponding photosensitive drum 14. Subsequently, the photosensitive drum 14 is exposed to the laser beam emitted by the scanner unit 8, forming an electrostatic latent image on the surface of the photosensitive drum 14 based on image data.

The toner carried on the developing roller 17 is then supplied to the electrostatic latent image on the surface of the photosensitive drum 14 to produce a toner image thereon.

Also during this time, the sheets P accommodated in the sheet supply tray 6 are supplied to the registration rollers 7. The registration rollers 7 rotate to convey the sheets P one at a time along a U-shaped path, which changes a conveying direction of the sheet P from a forward direction to a direction sloped diagonally upward and rearward, to a position between the conveying belt 22 and the photosensitive drums 14 at a prescribed timing.

The conveying belt 22 subsequently conveys the sheet P rearward so that the sheet P passes sequentially between each of the photosensitive drums 14 and the transfer rollers 23. At this time, toner images carried on the photosensitive drums 14 are transferred to the sheet P.

The sheet P is subjected to heat and pressure while passing between the heating roller 24 and the pressure roller 25 of the fixing unit 11, thereby fixing the image to the sheet P.

Subsequently, discharge rollers 26 convey the sheet P along a U-shaped path that changes the conveying direction from a rearward direction to a direction sloped diagonally upward and forward, and discharge the sheet P onto a discharge tray 27 formed on a top surface of the main casing 2.

2. Detailed Description of Process Unit (1) Process Frame

The process frame 12 has a frame-like shape that is substantially rectangular in a plan view. The process frame 12 has a left wall 31 (see FIG. 1) and a right wall 32 (see FIGS. 9A and 9B).

As illustrated in FIG. 1, the left wall 31 is disposed at a left end portion of the process frame 12. The left wall 31 has a substantially rectangular shape in a side view, elongated in the front-rear direction.

The right wall 32 is disposed at a right end portion of the process frame 12. The right wall 32 is disposed rightward of the left wall 31 and spaced apart from the left wall 31. The right wall 32 has a substantially rectangular shape in a side view, elongated in the front-rear direction. The right wall 32 includes a plurality of (four in the embodiment) process-frame-side electrodes 34 as an example of an external electrode.

Figure 9A:
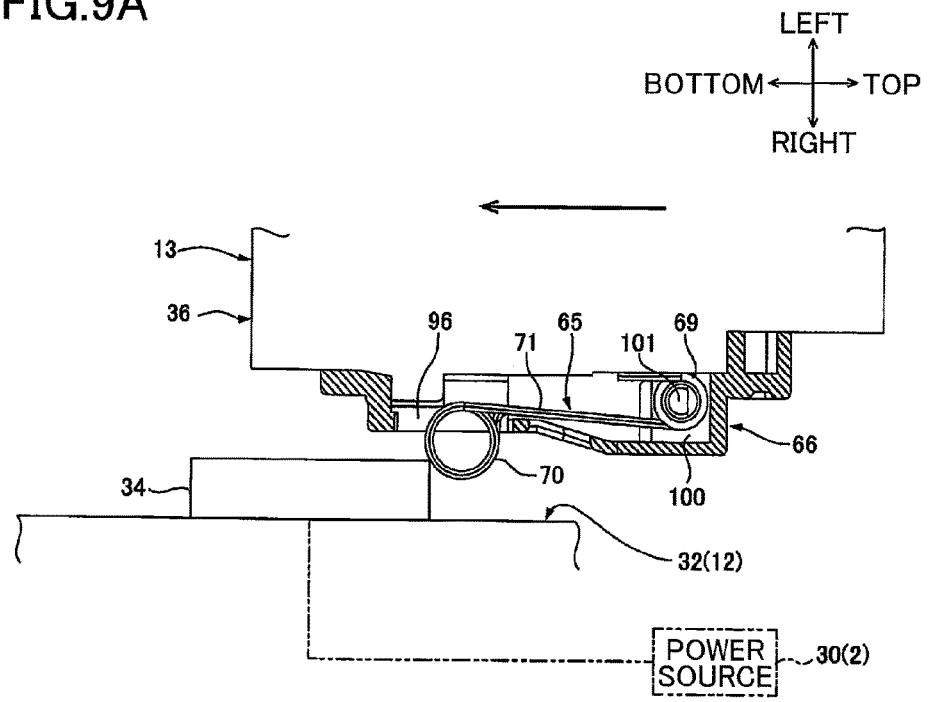
FIG. 9A is an explanatory view for illustrating attachment and detachment of the developing cartridge relative to a process frame of the printer, in which the developing cartridge is in the course of attachment or detachment relative to the process frame.
Figure 9B:
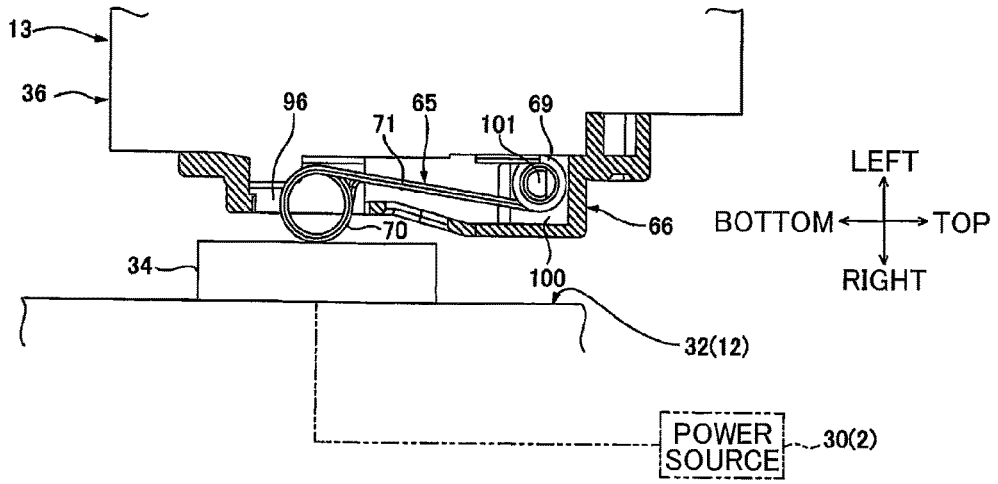
FIG. 9B is an explanatory view for illustrating attachment and detachment of the developing cartridge relative to the process frame of the printer, in which the developing cartridge has been attached.

The four process-frame-side electrodes 34 are provided so as to correspond to coil electrodes 65 (described later) of the four developing cartridges 13, respectively. The four process-frame-side electrodes 34 are each disposed diagonally above and frontward of the corresponding photosensitive drum 14. As illustrated in FIGS. 9A and 9B, the process-frame-side electrodes 34 each have a substantially prismatic columnar shape that protrudes leftward from a left surface of the right wall 32.

Each process-frame-side electrode 34 integrally includes a power receiving portion (not illustrated) exposed to outside from a right surface of the right wall 32. In a state where the process unit 9 is mounted in the main casing 2, each power receiving portion (not illustrated) contacts a main-casing-side electrode (not illustrated) disposed in the main casing 2 to electrically connect the process-frame-side electrode 34 to a power source 30 provided in the main casing 2, as denoted by imaginary lines in FIGS. 9A and 9B.

(2) Developing Cartridge (2-1) Structure of Developing Cartridge

Figure 2:
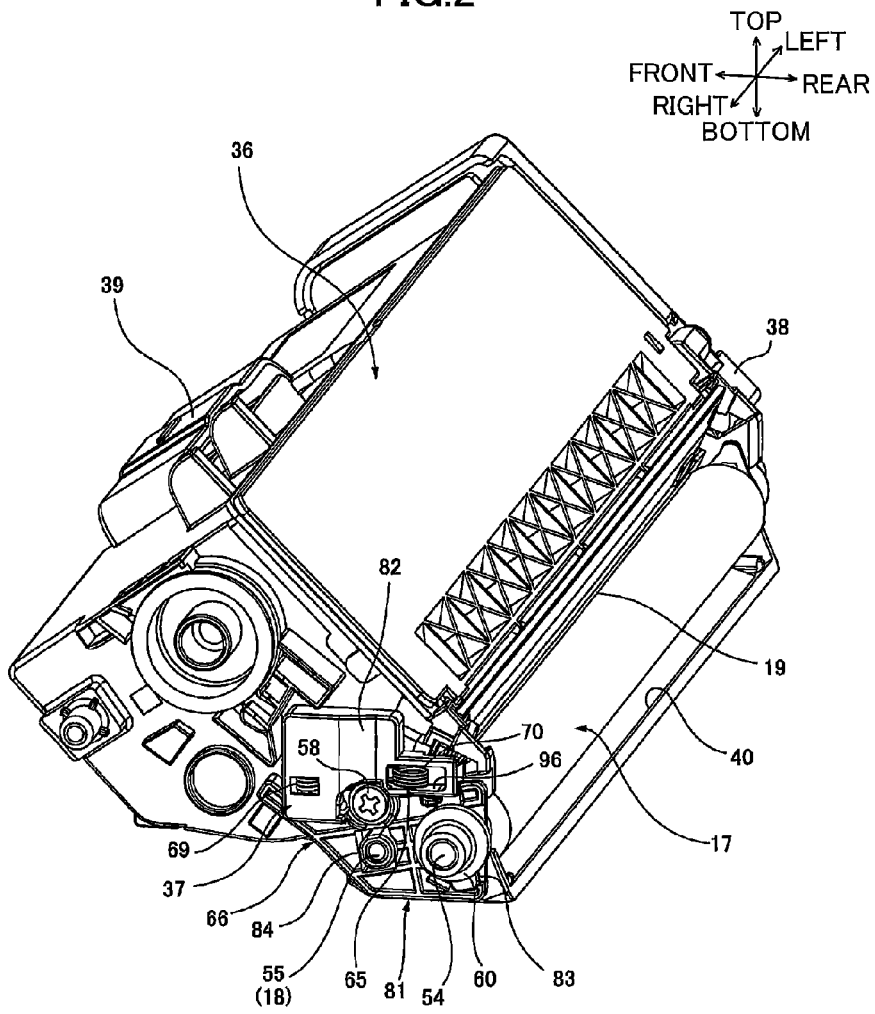
FIG. 2 is a perspective view of the developing cartridge of FIG. 1 as viewed from an upper right side thereof.

As illustrated in FIG. 2, each developing cartridge 13 further includes a developing frame 36 as an example of a first frame, an electrode unit 37, and a drive unit 38.

Hereinafter, when referring to directions in relation to the developing cartridge 13, a vertical direction (up-down direction) thereof is defined as an axial direction of a first axis 77 and a second axis 78 of a coil electrode 65 (described later). More specifically, the developing cartridge 13 will be described based on direction arrows indicated in the drawings. That is, up-down and front-rear directions related to the developing cartridge 13 are slightly different from those related to the printer 1. The developing cartridge 13 is attached to the printer 1 such that the rear side thereof is located at the lower-rear side of the printer 1 and the front side thereof is located at the upper-front side of the printer 1.

The developing frame 36 has a box-like shape that is elongated in the left-right direction and formed in a substantially isosceles triangle shape in a side view with a vertex angle pointing in a lower-rear direction. The developing frame 36 includes a handle 39 and an opening portion 40.

The handle 39 is disposed at an upper-front end portion of the developing frame 36. The handle 39 is formed in a flat plate-like shape that is substantially inverted U-shaped as viewed from an upper-rear side thereof.

The opening portion 40 penetrates a lower-rear end portion of the developing frame 36 across the entire developing frame 36 in the left-right direction to provide communication between the interior and exterior of the developing frame 36.

Figure 3:
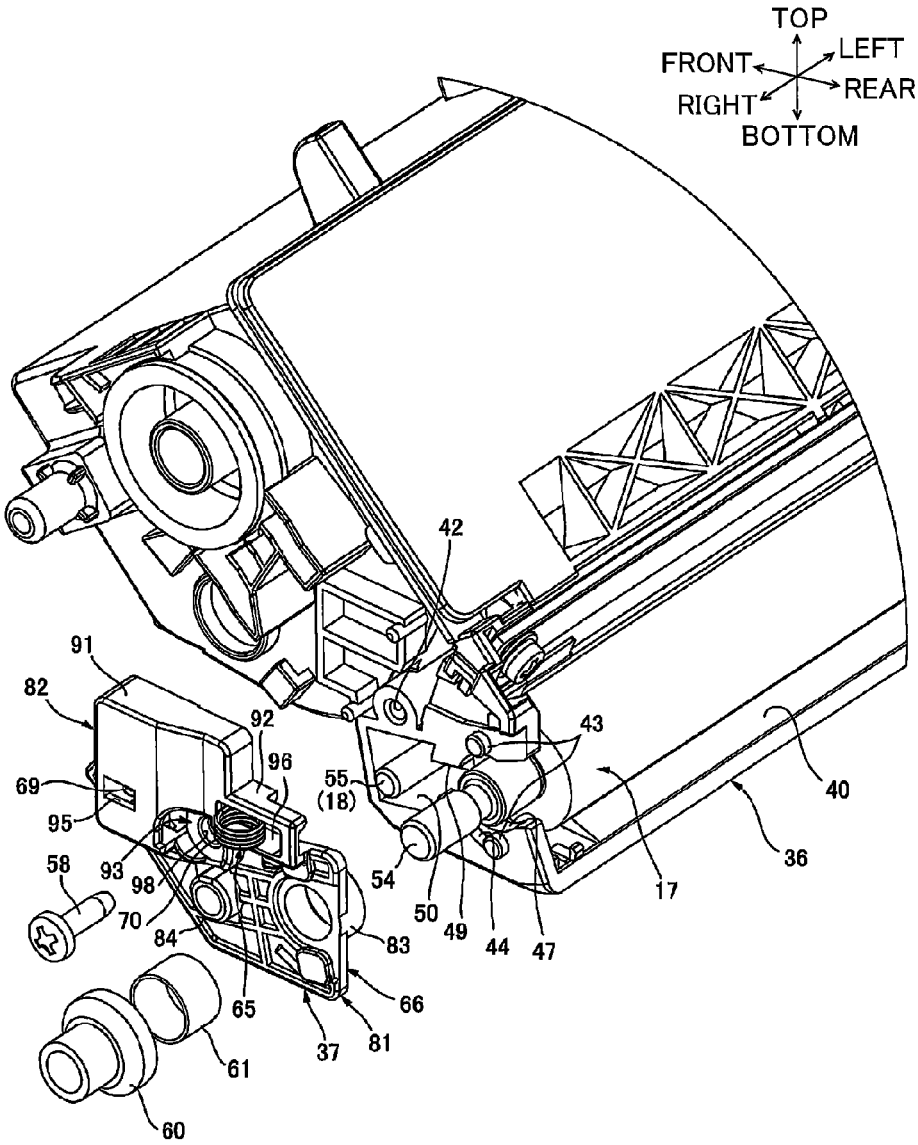
FIG. 3 is an enlarged exploded perspective view of the developing cartridge of FIG. 1 as viewed from an upper right side thereof.

As illustrated in FIG. 3, the developing frame 36 has, at its right wall, a developing roller shaft insertion groove 47, a communication groove 49, a supply roller shaft bearing fitting portion 50, a pair of positioning bosses 43, a locking hole 44, and a screw hole 42.

The developing roller shaft insertion groove 47 has a substantially U-shape in a side view, cut out frontward from a rear edge of the developing frame 36 at a lower end portion of the developing frame 36 and opened rearward.

The communication groove 49 has a substantially rectangular shape in a side view, continuing from a front end portion of the developing roller shaft insertion groove 47 and extending frontward.

The supply roller shaft bearing fitting portion 50 has a substantially rectangular shape in a side view, continuing from a front end portion of the communication groove 49, spreading in the up-down direction, and extending frontward.

The pair of positioning bosses 43 includes an upper positioning boss 43 and a lower positioning boss 43.

The locking hole 44 is positioned frontward of the lower positioning boss 43. The locking hole 44 has a substantially rectangular shape in a side view, penetrating the right wall of the developing frame 36 in the left-right direction.

The screw hole 42 is disposed above the supply roller shaft bearing fitting portion 50

As illustrated in FIG. 2, the electrode unit 37 is disposed at a right end portion of the developing cartridge 13. The electrode unit 37 includes the coil electrode 65 as an example of an electrode member and an electrode cover 66 as an example of a second frame. That is, the electrode cover 66 is assembled to one end (right end) of the developing frame 36 in the extending direction (left-right direction). The developing frame 36 and the electrode cover 66 constitutes, for example, a frame.

The coil electrode 65 is formed of a wire rod made of stainless steel or the like. As illustrated in FIGS. 4A through 4D, the coil electrode 65 includes an urging portion 69, a contact portion 70, a connecting portion 71, a first arm portion 72, an engaging portion 74, and a second arm portion 73.

The urging portion 69 has a coil shape in which a wire rod is helically wound about the first axis 77. The first axis 77 extends in the up-down direction and serves as a central axis of the urging portion 69. The urging portion 69 functions as a torsion spring.

The contact portion 70 is disposed at a rear-right side of the urging portion 69 and spaced apart from the urging portion 69. The contact portion 70 has a coil shape in which a wire rod is helically wound about the second axis 78. The second axis 78 extends in the up-down direction. That is, the second axis 78 is aligned parallel with the first axis 77. The second axis 78 serves as a central axis of the contact portion 70. The coil shape of the contact portion 70 has a radius larger than that of the coil shape of the urging portion 69.

The connecting portion 71 has a substantially linear shape extending from an upper end of the urging portion 69 to a lower end of the contact portion 70. In other words, the connecting portion 71 connects one end of the wire rod constituting the urging portion 69 and one end of the wire rod constituting the contact portion 70. Specifically, the connecting portion 71 tangentially extends from a front-right end portion at the upper end of the urging portion 69 toward a rear-right side thereof, and is then tangentially connected to a rear-left end portion at the lower end of the contact portion 70. That is, the connecting portion 71 extends from the upper end of the urging portion 69 in a direction in which a tangent to the urging portion 69 at a front-right edge of the urging portion 69 extends, and leads to the lower end of the contact portion 70 while extending in a direction in which a tangent to the contact portion 70 at the rear-left edge of the contact portion 70 extends.

The first arm portion 72 has a substantially linear shape extending rearward from a lower end of the urging portion 69. In other words, the first arm portion 72 extends rearward from another end of the wire rod constituting the urging portion 69. Specifically, the first arm portion 72 tangentially extends rearward from a left end portion at the lower end of the urging portion 69. That is, the first arm portion 72 extends in a direction in which a tangent to the urging portion 69 at the left edge of the urging portion 69 extends. In other words, one end (front end) of the wire rod constituting the first arm portion 72 is continuous with the other end of the wire rod constituting the urging portion 69.

The engaging portion 74 has a substantially L-shape that is bent rightward at a rear end of the first arm portion 72, extends slightly rightward, and is then bent rearward. In other words, the engaging portion 74 extends from another end (rear end) of the wire rod constituting the first arm portion 72. The engaging portion 74 is positioned opposite to the urging portion 69 with respect to the first arm portion 72.

Figure 4A:
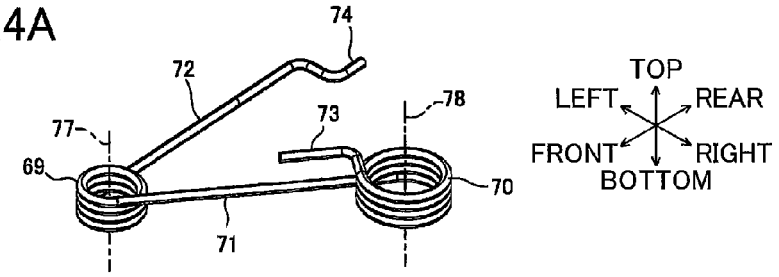
FIG. 4A is a perspective view of a coil electrode of FIG. 3 as viewed from an upper right side thereof.
Figure 4B:
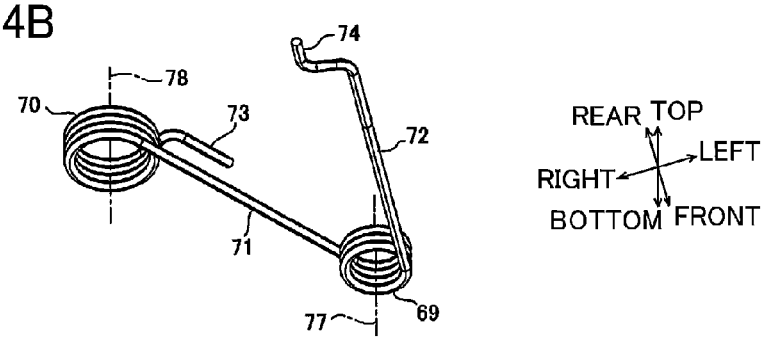
FIG. 4B is a perspective view of the coil electrode of FIG. 3 as viewed from a lower left side thereof.
Figure 4C:
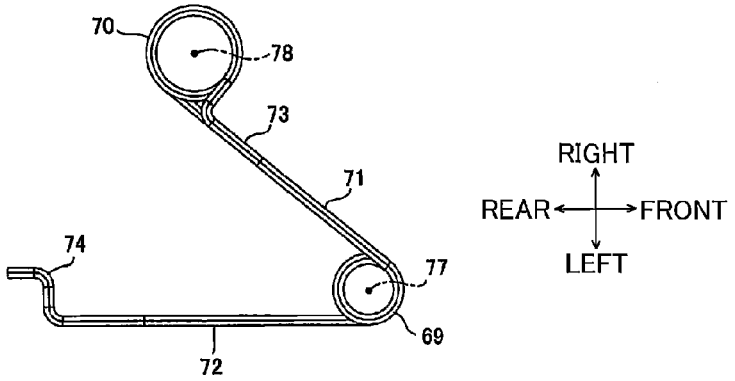
FIG. 4C is a plan view of the coil electrode of FIG. 3.
Figure 4D:
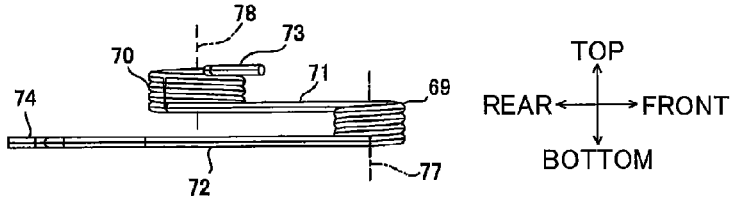
FIG. 4D is a left side view of the coil electrode of FIG. 3.

The second arm portion 73 has a substantially L-shape that is bent frontward and leftward at an upper end of the contact portion 70. That is, the second arm portion 73 extends from another end of the wire rod constituting the contact portion 70. Specifically, the second arm portion 73 tangentially extends from a front-left end portion at the upper end of the contact portion 70 toward a rear-left side thereof, and is then bent forward and leftward and tangentially extends forward and leftward. That is, the second arm portion 73 extends from the upper end of the contact portion 70 in a direction in which a tangent to the contact portion 70 at a front-left edge of the contact portion 70 extends, and is then bent frontward and leftward at a rear-left end of the extending portion of the second arm portion 73, and then, extends in a direction in which a tangent to the contact portion 70 at a rear-left edge of the contact portion 70 extends. As illustrated in FIG. 4C, the second arm portion 73 is overlapped with the connecting portion 71 as viewed from above. Further, as illustrated in FIG. 4D, the second arm portion 73 extends parallel to the connecting portion 71.

Figure 5A:
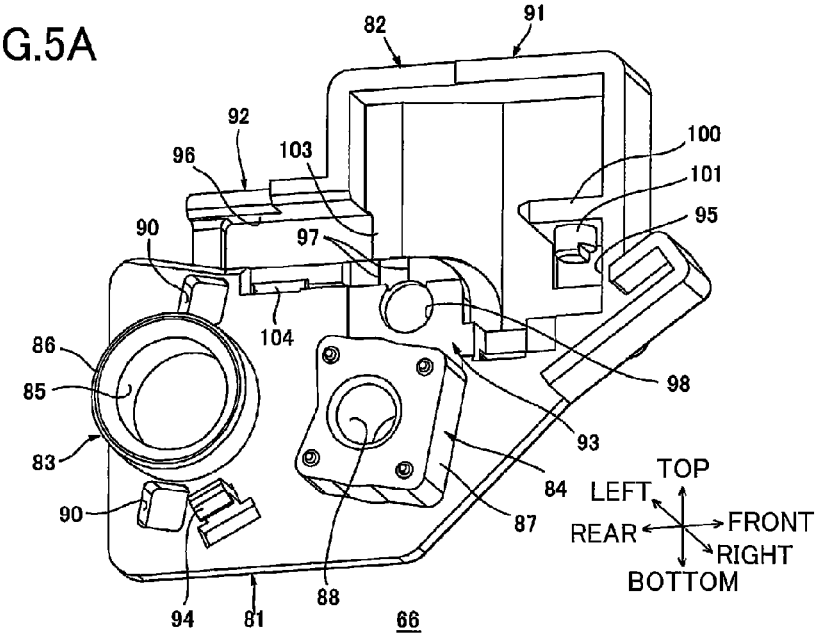
FIG. 5A is a perspective view of an electrode cover of FIG. 3 as viewed from a front left side thereof.
Figure 5B:
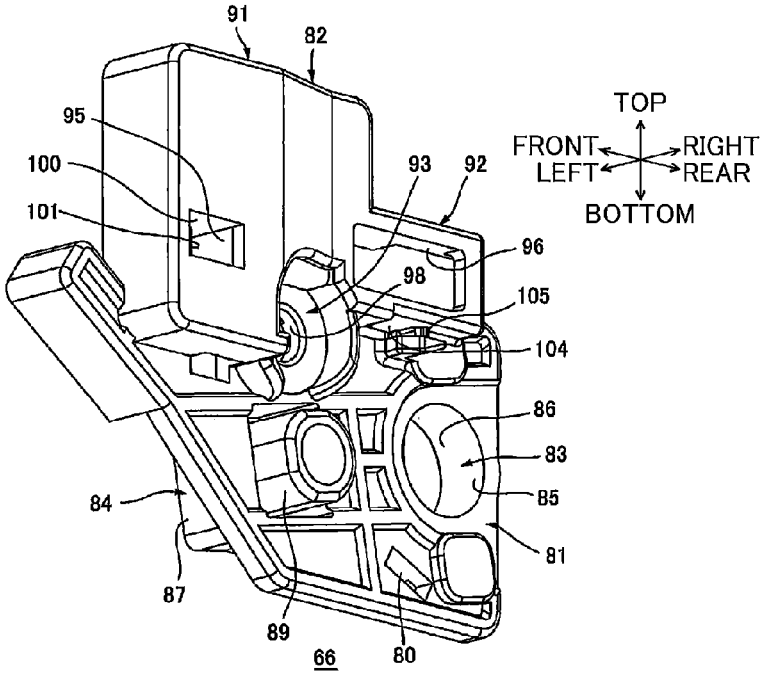
FIG. 5B is a perspective view of the electrode cover of FIG. 3 as viewed from a front right side thereof.

As illustrated in FIGS. 5A and 5B, the electrode cover 66 integrally includes a bearing portion 81 and a coil support portion 82. The electrode cover 66 is formed of an electrically-conductive material such as electrically-conductive resin.

The bearing portion 81 has a flat plate-like shape that is substantially rectangular in a side view. The bearing portion 81 constitutes a lower portion of the electrode cover 66. The bearing portion 81 includes an electrode-side developing roller shaft bearing portion 83, an electrode-side supply roller shaft bearing portion 84, a pair of cover positioning concave portions 90, and a locking hook 94.

The electrode-side developing roller shaft bearing portion 83 is disposed at a rear end portion of the bearing portion 81. The electrode-side developing roller shaft bearing portion 83 has a developing roller shaft insertion hole 85 and a developing roller shaft support portion 86.

The developing roller shaft insertion hole 85 has a substantially circular shape in a side view and penetrates the bearing portion 81 in the left-right direction.

The developing roller shaft support portion 86 has a substantially cylindrical shape and extends leftward from a left surface of the bearing portion 81 so as to define a periphery of the developing roller shaft insertion hole 85. The developing roller shaft support portion 86 has an inner diameter substantially equal to a diameter of the developing roller shaft insertion hole 85. The developing roller shaft support portion 86 has an outer diameter slightly smaller than an up-down length of the developing roller shaft insertion groove 47 of the developing frame 36. That is, the outer diameter of the developing roller shaft support portion 86 is slightly smaller than a distance between upper and lower edges defining the developing roller shaft insertion groove 47.

The electrode-side supply roller shaft bearing portion 84 is disposed at a substantial center portion of the bearing portion 81 in the front-rear direction. The electrode-side supply roller shaft bearing portion 84 is disposed frontward of the electrode-side developing roller shaft bearing portion 83 and spaced apart therefrom. The electrode-side supply roller shaft bearing portion 84 has a supply roller shaft support portion 87, a supply roller shaft insertion hole 88, and a supply roller shaft collar portion 89.

The supply roller shaft support portion 87 has a substantially prismatic columnar shape that protrudes leftward from the left surface of the bearing portion 81. The supply roller shaft support portion 87 has an outer shape in a left side view slightly smaller than an inner shape of the supply roller shaft bearing fitting portion 50 of the developing frame 36 in a right side view.

The supply roller shaft insertion hole 88 penetrates the supply roller shaft support portion 87 in the left-right direction at a position substantially center thereof in the up-down and front-rear directions. The supply roller shaft insertion hole 88 has a substantially circular shape in a side view.

The supply roller shaft collar portion 89 has a substantially cylindrical shape and extends rightward from a right surface of the bearing portion 81 so as to define a periphery of the supply roller shaft insertion hole 88. The supply roller shaft collar portion 89 has an inner diameter substantially equal to a diameter of the supply roller shaft insertion hole 88.

The pair of cover positioning concave portions 90 includes an upper cover positioning concave portion 90 and a lower cover positioning concave portion 90. The pair of cover positioning concave portions 90 is disposed so as to interpose the developing roller shaft insertion hole 85 therebetween in the up-down direction. Further, the upper cover positioning concave portion 90 is recessed rightward from the left surface of the bearing portion 81 so as to receive the upper positioning boss 43 of the developing frame 36, and the lower cover positioning concave portion 90 is recessed rightward from the left surface of the bearing portion 81 so as to receive the lower positioning boss 43 of the developing frame 36. The pair of cover positioning concave portions 90 each has a substantially rectangular shape in a side view.

The locking hook 94 is disposed frontward of the lower cover positioning concave portion 90. The locking hook 94 has a hook shape that protrudes leftward from the left surface of the bearing portion 81 and then bends frontward and downward at a left end portion of the protruding portion.

The coil support portion 82 has a flat plate-like shape that is substantially rectangular in a side view. The coil support portion 82 constitutes an upper portion of the electrode cover 66. The coil support portion 82 includes a first covering portion 91, a second covering portion 92, and a screwed portion 93.

The first covering portion 91 is disposed at a front portion of the coil support portion 82. The first covering portion 91 has a substantially rectangular frame-like shape that is closed on a right end and open on a left side. The first covering portion 91 has a first exposing hole 95, an extended portion 100, and a support portion 101.

The first exposing hole 95 penetrates the first covering portion 91 in the left-right direction at a lower-front end portion thereof. The first exposing hole 95 has a substantially rectangular shape in a side view.

The extended portion 100 extends leftward from a left surface of the first covering portion 91 at an upper periphery of the first exposing hole 95. The extended portion 100 has a flat plate-like shape that is substantially rectangular in a plan view.

The support portion 101 has a substantially cylindrical shape and protrudes downward from a lower surface of the extended portion 100. The support portion 101 has an outer diameter slightly smaller than an inner diameter of the urging portion 69 of the coil electrode 65.

The second covering portion 92 is disposed at a rear portion of the coil support portion 82. The second covering portion 92 extends rearward from a lower-rear edge of the first covering portion 91. The second covering portion 92 has a substantially rectangular frame-like shape that is closed on a right end and open on a left side. The second covering portion 92 is elongated in the front-rear direction. The second covering portion 92 has a second exposing hole 96 as an example of a guide portion and as an example of an exposing hole, an engagement groove 104 as an example of an engagement portion, and an engagement rib 105.

The second exposing hole 96 penetrates the second covering portion 92 in the left-right direction at a position substantially center thereof in the up-down and front-rear directions. The second exposing hole 96 has a substantially rectangular shape in a side view. Front-rear and up-down lengths of the second exposing hole 96 are slightly longer than front-rear and up-down lengths of the contact portion 70 of the coil electrode 65, respectively. That is, a distance between front and rear edges defining the second exposing hole 96 is slightly greater than the front-rear length of the contact portion 70, and a distance between upper and lower edges defining the second exposing hole 96 is slightly longer than the up-down length of the contact portion 70.

The second covering portion 92 further includes a restricting portion 103 at a front periphery of the second exposing hole 96.

The engagement groove 104 penetrates the second covering portion 92 in the left-right direction at a lower end portion thereof. The engagement groove 104 has a substantially rectangular shape in a side view. A front-rear length of the engagement groove 104 is longer than a front-rear length of the engaging portion 74 of the coil electrode 65. That is, a distance between front and rear edges defining the engagement groove 104 is greater than the front-rear length of the engaging portion 74. Further, an up-down length of the engagement groove 104 is slightly longer than a diameter of the wire rod constituting the coil electrode 65. That is, a distance between upper and lower edges defining the engagement groove 104 is slightly greater than the diameter of the wire rod constituting the coil electrode 65.

The engagement rib 105 is disposed rearward of the engagement groove 104. The engagement rib 105 protrudes rightward from a right surface of the second covering portion 92. The engagement rib 105 is a protrusion extending in the up-down direction.

The screwed portion 93 is disposed at a lower portion of the coil support portion 82 at a position substantially center thereof in the front-rear direction. The screwed portion 93 is continuously formed with a lower-rear edge of the first covering portion 91 and a lower-front edge of the second covering portion 92, and recessed leftward. The screwed portion 93 has a substantially circular shape in a side view. The screwed portion 93 has a screw insertion hole 98 and a plurality of (two in the embodiment) crush ribs 97. A combination of the plurality of crush ribs 97 and the engagement rib 105 is an example of a plurality of ribs.

The screw insertion hole 98 penetrates the screwed portion 93 in the left-right direction at a position substantially center thereof in the up-down and front-rear directions. The screw insertion hole 98 has a substantially circular shape in a side view.

The pair of crush ribs 97 is disposed above the screw insertion hole 98. The pair of crush ribs 97 is disposed spaced apart from each other in the front-rear direction. The pair of crush ribs 97 each protrudes leftward from a left surface of the screwed portion 93. The pair of crush ribs 97 are each a protrusion extending in the up-down direction.

As illustrated in FIG. 2, the drive unit 38 is disposed at a left end portion of the developing cartridge 13. The drive unit 38 includes a gear train (not illustrated) and is configured to transmit a drive force from a drive source (not illustrated) provided in the main casing 2 to the developing roller 17 and the supply roller 18 through the gear train (not illustrated).

The developing roller 17 is supported to the developing frame 36 such that a left end portion of the developing roller shaft 54 is rotatably supported at a drive-side developing roller shaft bearing portion (not illustrated) of the drive unit 38 and a right end portion of the developing roller shaft 54 is rotatably supported at the electrode-side developing roller shaft bearing portion 83 of the electrode unit 37. Hence, the developing roller 17 is rotatably supported at the developing frame 36 such that a rear end portion of the developing roller 17 is exposed to outside through the opening portion 40.

The supply roller 18 is supported to the developing frame 36 such that a left end portion of the supply roller shaft 55 is rotatably supported at a drive-side supply roller shaft bearing portion (not illustrated) of the drive unit 38 and a right end portion of the supply roller shaft 55 is rotatably supported by the electrode-side supply roller shaft bearing portion 84 of the electrode unit 37. Hence, the supply roller 18 is rotatably supported at the developing frame 36.

(2-2) Assembly of Electrode Unit to Developing Frame

In assembling the electrode unit 37 to the developing frame 36, first, the coil electrode 65 is assembled to the electrode cover 66.

Figure 6A:
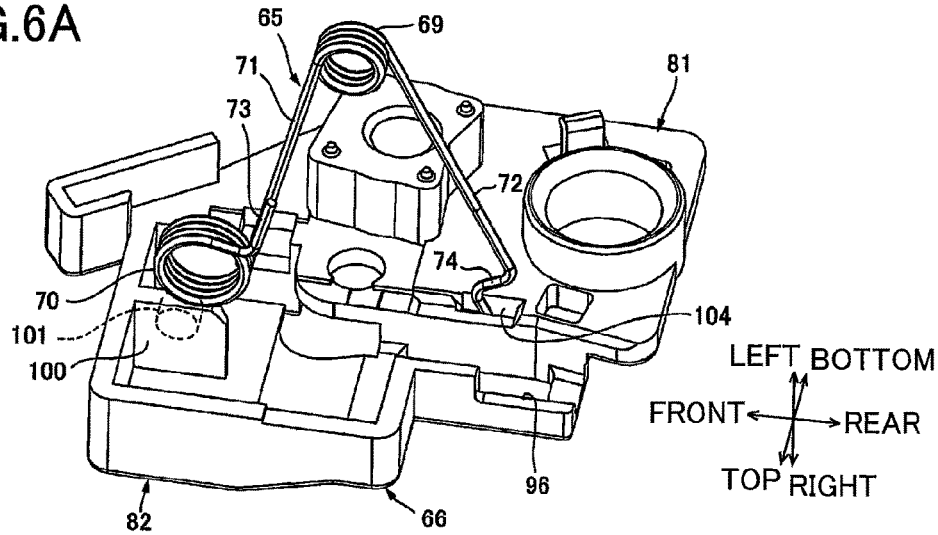
FIG. 6A is an explanatory view for illustrating assembly of the coil electrode to the electrode cover to provide an electrode unit, in which an engaging portion of the coil electrode is inserted into an engagement groove of the electrode cover.

In order to assemble the coil electrode 65 to the electrode cover 66, first, the engaging portion 74 of the coil electrode 65 is inserted, from the right, into the engagement groove 104 of the electrode cover 66, as illustrated in FIG. 6A.

Figure 6B:
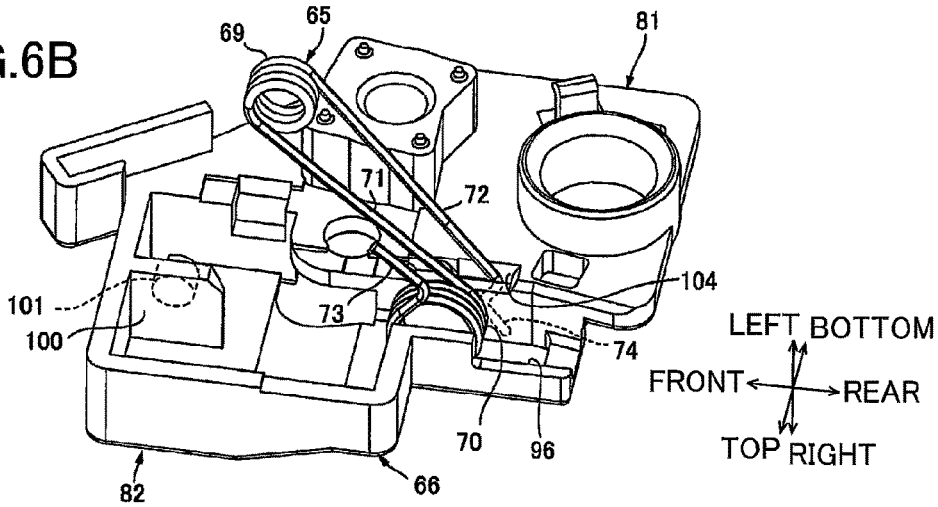
FIG. 6B is an explanatory view for illustrating the assembly of the coil electrode to the electrode cover to provide the electrode unit, in which the coil electrode is pivotally moved relative to the electrode cover.

Subsequently, as illustrated in FIG. 6B, the contact portion 70 is pivotally moved about the urging portion 69 counterclockwise in a plan view against an urging force caused by torsional force generated about the first axis 77 of the urging portion 69. Then, the contact portion 70 is disposed so as to be overlapped with the second exposing hole 96 as viewed from the left, and retained in the second exposing hole 96.

Figure 6C:
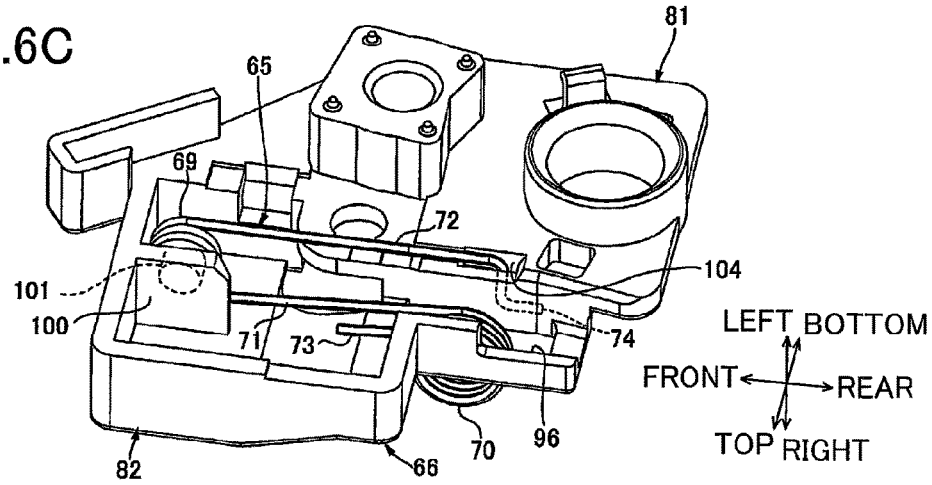
FIG. 6C is an explanatory view for illustrating the assembly of the coil electrode to the electrode cover to provide the electrode unit, in which the assembly of the coil electrode to the electrode cover has been completed.

Next, as illustrated in FIG. 6C, the urging portion 69 is pivotally moved about the engaging portion 74 and the contact portion 70 counterclockwise in a plan view.

Then, the urging portion 69 is fitted with the support portion 101 from below. That is the urging portion 69 is supported by the support portion 101.

The engaging portion 74 and the urging portion 69 are thus assembled to the coil support portion 82, whereby a position of the coil electrode 65 with respect to the electrode cover 66 is fixed.

Thereafter, the contact portion 70 is urged by the urging force of the urging portion 69 so as to be pivotally moved about the urging portion 69 clockwise in a plan view.

Figure 7A:
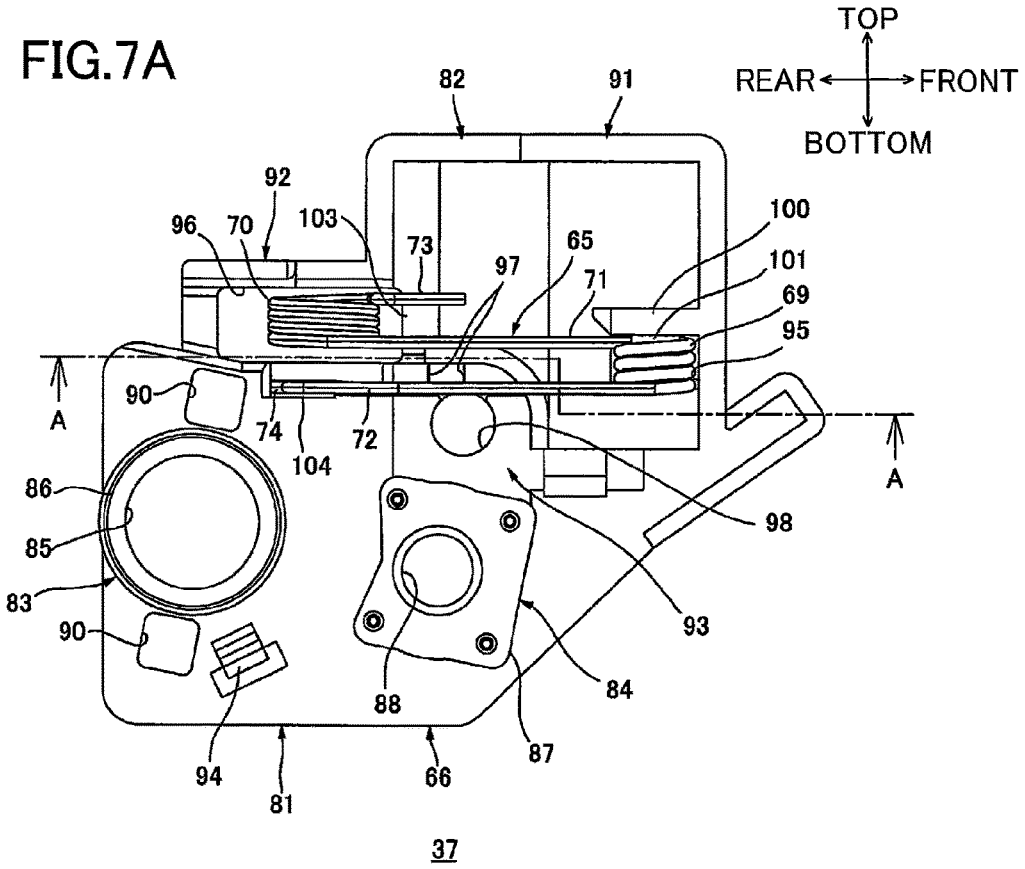
FIG. 7A is a left side view of the electrode unit.
Figure 7B:
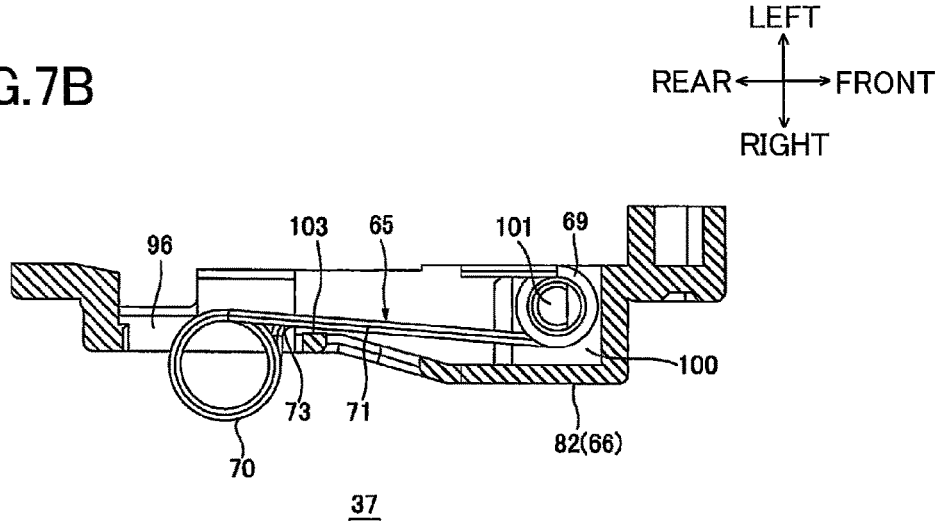
FIG. 7B is a cross-sectional view of the electrode unit taken along a line A-A illustrated in FIG. 7A.

Hence, as illustrated in FIG. 7B, a right end of the contact portion 70 protrudes, through the second exposing hole 96, rightward further than a right end of the coil support portion 82. Further, the connecting portion 71 and the second arm portion 73 contact the restricting portion 103 from the left.

That is, the contact portion 70 is guided by the second exposing hole 96 and is, thereby, pivotally movable about the urging portion 69 in a plane normal to both the first axis 77 and the second axis 78.

Figure 8A:
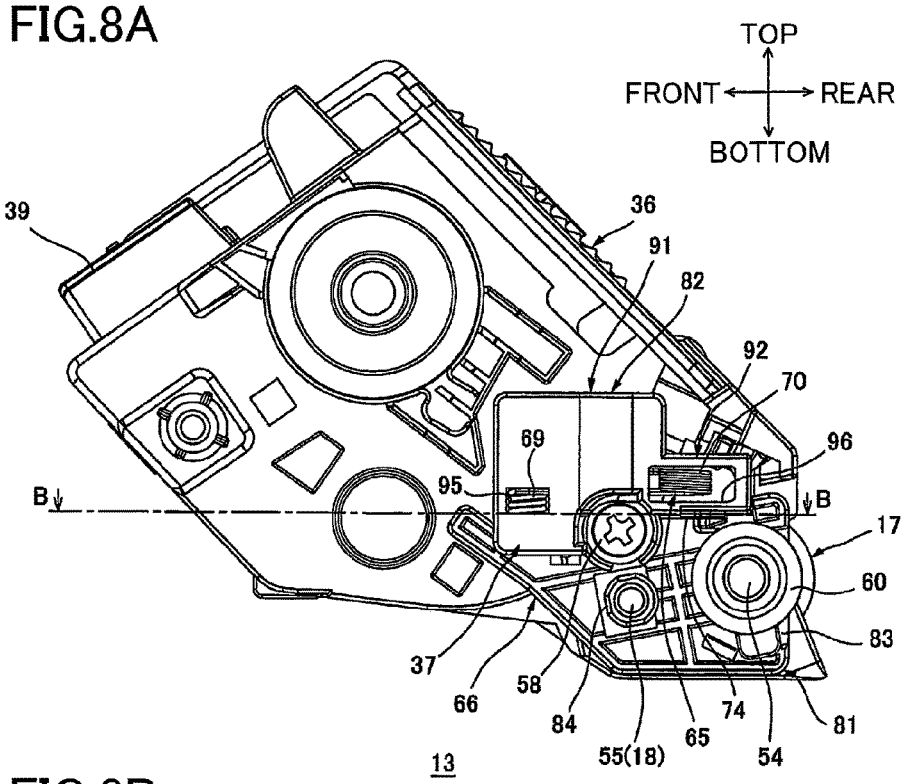
FIG. 8A is a right side view of the developing cartridge.
Figure 8B:
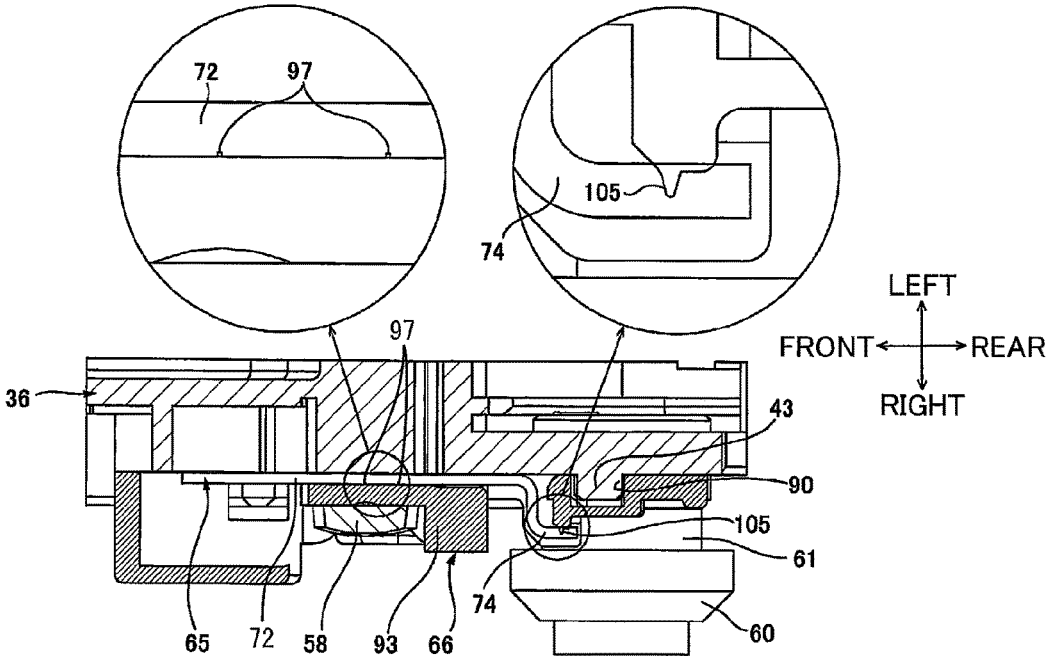
FIG. 8B is a cross-sectional view of the developing cartridge taken along a line B-B illustrated in FIG. 8A.

Further, as illustrated in FIGS. 8A and 8B, in a state where the electrode cover 66 to which the coil electrode 65 has been assembled is attached to the developing frame 36, the engaging portion 74 is in contact with the electrode cover 66 so as to crush the engagement rib 105, and the first arm portion 72 is in contact with the electrode cover 66 so as to crush the pair of crush ribs 97.

As a result, the coil electrode 65 reliably contacts the electrode cover 66.

Incidentally, for clarity of the configuration in which the coil electrode 65 and the electrode cover 66 are in contact with each other, in FIGS. 8A and 8B, the engagement rib 105 and the pair of crush ribs 97 are illustrated as if they were not crushed.

Next, as illustrated in FIG. 3, the electrode cover 66 to which the coil electrode 65 has been assembled, i.e., the electrode unit 37, is assembled to the developing frame 36.

In order to assemble the electrode unit 37 to the developing frame 36, the bearing portion 81 is subjected to positioning with respect to the developing frame 36 such that the cover positioning concave portions 90 are fitted with the corresponding positioning bosses 43 and the locking hook 94 is engaged with the locking hole 44.

As a result, the electrode cover 66 is assembled to the developing frame 36 from the right.

In this state, the screw hole 42 of the developing frame 36 is exposed to outside through the screw insertion hole 98 of the electrode cover 66.

Then, a screw 58 is threadingly engaged with the screw hole 42 through the screw insertion hole 98 of the electrode cover 66 and the first arm portion 72 of the coil electrode 65. The first arm portion 72 is thus sandwiched between the electrode cover 66 and the developing frame 36 in the left-right direction as illustrated in FIG. 8B, thereby allowing the first arm portion 72 to reliably abut against the pair of crush ribs 97. Hence, the coil electrode 65 and the electrode cover 66 can reliably abut against each other.

Further, as illustrated in FIG. 3, a developing roller shaft collar portion 60 and an urging member 61 are assembled to the developing roller shaft 54.

As a result, the assembly operation of the electrode unit 37 to the developing frame is completed.

3. Attachment and Detachment of Developing Cartridge Relative to Main Casing (1) Attachment and Detachment of Developing Cartridge Relative to Process Unit In order to attach the developing cartridge 13 to the main casing 2, first, the developing cartridge 13 is attached to the process frame 12, as illustrated in FIG. 1.

In attaching the developing cartridge 13 to the process frame 12, the developing cartridge 13 is positioned above the process frame 12 withdrawn to an outside of the main casing 2, then moved downward and inserted into the process frame 12 such that the rear portion of the developing cartridge 13 is oriented downward.

Then, as illustrated in FIG. 9A, the right end of the contact portion 70 abuts against the process-frame-side electrode 34.

When the developing cartridge 13 is further inserted into the process frame 12, the contact portion 70 is pivotally moved leftward about the urging portion 69 against the urging force of the urging portion 69 to ride up on the process-frame-side electrode 34 while being guided by the second exposing hole 96.

Hence, the contact portion 70 is urged by the urging portion 69 to be brought into pressure contact with the process-frame-side electrode 34 (see FIG. 9B).

Subsequently, as illustrated in FIG. 1, the developing cartridge 13 is pivotally moved counterclockwise in a side view relative to the process frame 12 to cause the developing roller 17 to abut against the photosensitive drum 14, whereby the attaching operation of the developing cartridge 13 to the process frame 12 is completed.

The developing cartridge 13 is detached from the process frame 12 by performing the operation to attach the developing cartridge 13 to the process frame 12 described above in reverse.

(2) Mounting and Withdrawing of Process Unit Relative to Main Casing

Next, the process unit 9 is mounted in the main casing 2. In mounting the process unit 9 in the main casing 2, the process unit 9 is inserted rearward into the main casing 2.

When the process unit 9 is fully inserted into the main casing 2, the four photosensitive drums 14 are brought into contact with the conveying belt 22 from above. Thereafter, the front cover 5 is pivotally moved rearward to close the opening formed in the front wall of the main casing 2.

As a result, the mounting operation of the process unit 9 in the main casing 2 is completed.

In withdrawing the process unit 9 mounted in the main casing 2 from the main casing 2, the front cover 5 is pivotally moved frontward, and the process unit 9 is withdrawn frontward.

(3) Electric Power Supply

As illustrated in FIG. 9B, upon attachment of the developing cartridge 13 to the main casing 2, electric power is supplied from the power source 30 of the main casing 2 to the coil electrode 65 through the power receiving portion (not illustrated) of the right wall 32 of the process frame 12.

The electric power supplied to the coil electrode 65 is supplied to the developing roller shaft 54 and the supply roller shaft 55 through the electrode cover 66, thereby simultaneously applying an equal bias to the developing roller 17 and the supply roller 18.

4. Operational Advantages (1) According to the printer 1 described above, as illustrated in FIGS. 9A and 9B, the contact portion 70 is urged about the urging portion 69 in the shape of a coil toward the process-frame-side electrode 34 to be brought into contact with the process-frame-side electrode 34, whereby electric power from the power source 30 of the main casing 2 can be supplied to the developing roller 17.

The coil electrode 65 is formed of a coil having a smaller spring constant than that of a leaf spring. Even when a displacement amount of the contact portion 70 changes due to contact with the process-frame-side electrode 34, a load acting on the process-frame-side electrode 34 and the contact portion 70 does not largely change, with the result that the contact portion 70 can be brought into contact with the process-frame-side electrode 34 with a constant load.

As a result, the use of the coil allows reliable supply of electric power to the developing roller 17 and the supply roller 18 while reducing production cost of the coil electrode 65.

(2) Further, according to the printer 1 described above, as illustrated in FIGS. 4A through 4D, the contact portion 70 is in the shape of a coil formed by a helically wound wire rod and has thus high rigidity.

Thus, the contact portion 70 can be suppressed from being damaged due to repetitive contact with the process-frame-side electrode 34.

As a result, the contact portion 70 and the process-frame-side electrode 34 can be reliably brought into contact with each other over a long period of time.

(3) Further, according to the printer 1 described above, as illustrated in FIGS. 4A through 4D, the urging portion 69 of the coil electrode 65 and the contact portion 70 of the coil electrode 65 are formed of coils having axes extending parallel to each other.

Thus, as illustrated in FIGS. 9A and 9B, the contact portion 70 is urged toward the process-frame-side electrode 34 by the urging force caused by the torsional force generated by the urging portion 69 about the first axis 77 thereof and can thus be brought into contact with the process-frame-side electrode 34. Further, a periphery of the wire rod wound about the second axis 78 of the contact portion 70 can be brought into contact with the process-frame-side electrode 34, whereby the contact portion 70 can be brought into contact with the process-frame-side electrode 34 with a constant contact pressure.

As a result, the contact portion 70 is urged by the urging force caused by the torsional force of the urging portion 69 and can thus be brought into stable contact with the process-frame-side electrode 34.

(4) Further, according to the printer 1 described above, as illustrated in FIGS. 9A and 9B, the contact portion 70 can be stably pivotally moved while being guided by the second exposing hole 96 with the coil electrode 65 supported by the electrode cover 66.

(5) Further, according to the printer 1 described above, as illustrated in FIGS. 6A through 6C, the urging portion 69 can be supported by the support portion 101 even in a state where the developing frame 36 and the electrode cover 66 are separated from each other.

Thus, a part of the coil electrode 65 can be temporarily assembled to the electrode cover 66 in a state where the developing frame 36 and the electrode cover 66 are separated from each other.

As a result, the temporary assembly of the part of the coil electrode 65 to the electrode cover 66 allows the coil electrode 65 to be easily assembled to the developing frame 36 simply by assembling the electrode cover 66 supporting the coil electrode 65, i.e., the electrode unit 37, to the developing frame 36.

Thus, assembling workability of the developing cartridge 13 can be enhanced.

(6) Further, according to the printer 1 described above, as illustrated in FIGS. 4A through 4D, the urging portion 69 and the contact portion 70 are connected to each other by the connecting portion 71, thereby allowing the contact portion 70 to be urged, through the connecting portion 71, by the urging force caused by the torsional force of the urging portion 69.

Further, the urging portion 69 and the contact portion 70 can be formed of a continuing wire rod.

Thus, the coil electrode 65 can be easily formed by a single wire rod.

(7) Further, according to the printer 1 described above, as illustrated in FIG. 8B, the first arm portion 72 extending from the lower end of the urging portion 69, i.e., the other end of the wire rod constituting the urging portion 69, is sandwiched between the developing frame 36 and the electrode cover 66, whereby the coil electrode 65 can be reliably fixed to the developing frame 36 and the electrode cover 66.

Further, the electrode cover 66 has the pair of crush ribs 97. Thus, the first arm portion 72 sandwiched between the developing frame 36 and the electrode cover 66 can be reliably brought into contact with the electrode cover 66 so as to crush the crush ribs 97.

(8) Further, according to the printer 1 described above, as illustrated in FIGS. 6A through 6C, engaging the engaging portion 74 with the electrode cover 66 allows temporary assembly of a part of the coil electrode 65 to the electrode cover 66 in a state where the electrode cover 66 is separated from the developing frame 36.

As a result, the temporary assembly of the part of the coil electrode 65 to the electrode cover 66 allows the coil electrode 65 to be easily assembled to the developing frame 36 simply by assembling the electrode cover 66 to the developing frame 36, so that assembling workability of the developing cartridge 13 can be further enhanced.

(9) Further, according to the printer 1 described above, as illustrated in FIGS. 7A and 7B, the connecting portion 71 and the second arm portion 73 abut against the restricting portion 103. This restricts inclination of the second axis 78 relative to the first axis 77, so that a position of the contact portion 70 with respect to the electrode cover 66 can be made stable.

Thus, the contact portion 70 can be brought into stable contact with the process-frame-side electrode 34.

(10) Further, according to the printer 1 described above, as illustrated in FIGS. 9A and 9B, the coil electrode 65 is supported by the electrode cover 66 supporting the right end portion of the developing roller shaft 54. Further, the electrode cover 66 has electrically-conductive properties.

Thus, bringing the contact portion 70 into contact with the process-frame-side electrode 34 allows electric power to be reliably supplied to the developing roller 17.

While the present invention has been described in detail with reference to the embodiment thereof, it would be apparent to those skilled in the art that various changes and modifications may be made therein without departing from the spirit of the present invention.

What is claimed is:

1. A developing cartridge comprising:
- a developing roller including a developing roller shaft;
- a developing frame for accommodating toner therein;
- a coil electrode for supplying the developing roller with electrical power, the coil electrode including:
  - a contact portion having a coil shape;
  - an urging portion having a coil shape; and
  - a connecting portion having a linear shape extending in a first direction, the connecting portion connecting the contact portion and the urging portion; and
- an electrode cover formed of an electrically-conductive material and assembled to the developing frame, the electrode cover having a flat plate-like shape, the electrode cover including:
  - a bearing portion having a developing roller shaft insertion hole for supporting the developing roller shaft; and
  - a coil support portion having an exposing hole, the contact portion of the coil electrode protruding through the exposing hole, the coil support portion including:
    - an extended portion extending from a surface of the electrode cover in the first direction, the extending portion having a flat plate-like shape; and
    - a support portion protruding from a surface of the extended portion in a second direction perpendicular to the first direction, the support portion having a cylindrical shape, the urging portion of the coil electrode being fitted with the support portion.

2. The developing cartridge according to claim 1,
- wherein the coil support portion of the electrode cover further has an engagement groove, and
- wherein the coil electrode further includes:
  - a first arm portion having a linear shape, the first arm portion extending in the first direction and connecting with the urging portion; and
  - an engagement portion having a linear shape, the engagement portion extending from an end of the first arm portion and inserted into the engagement groove of the electrode cover.

3. The developing cartridge according to claim 2, wherein the engagement portion of the coil electrode has a L-shape.

4. The developing cartridge according to claim 3, wherein the engagement portion of the coil electrode includes a first portion bent from an end of the first arm portion and a second portion bent from an end of the first portion, the second portion being parallel to the first arm portion.

5. The developing cartridge according to claim 2, wherein the coil support portion of the electrode cover further includes crush ribs extending in a second direction, the crush ribs contacting the first arm portion.

6. The developing cartridge according to claim 1, wherein the coil support portion of the electrode cover further has a screw insertion hole through which a screw is inserted.

7. The developing cartridge according to claim 1, wherein the contact portion of the coil electrode is pivotable between a first position and a second position closer than the first position to the developing frame.

8. The developing cartridge according to claim 1, wherein the coil electrode further includes a second arm portion having a linear shape, the second arm portion extending in the first direction and connecting with the contact portion.

9. The developing cartridge according to claim 8, wherein the second arm portion of the coil electrode is overlapped with the connecting portion of the coil electrode when viewed in a second direction.

10. The developing cartridge according to claim 1, wherein the contact portion of the coil electrode includes a first axis and the urging portion of the coil electrode includes a second axis, the first axis extending parallel to the second axis.

11. The developing cartridge according to claim 10, wherein the contact portion of the coil electrode is pivotable about the urging portion of the coil electrode in a direction perpendicular to both the first axis and the second axis.

12. The developing cartridge according to claim 1, wherein the contact portion of the coil electrode has a radius greater than the urging portion of the coil electrode.

13. A developing cartridge comprising:
- a developing roller including a developing roller shaft;
- a developing frame for accommodating toner therein;
- a coil electrode for supplying the developing roller with electrical power, the coil electrode including:
  - a contact coil;
  - an urging coil; and
  - a connecting arm extending in a first direction, the connecting arm connecting the contact coil and the urging coil; and
- an electrode cover formed of an electrically-conductive material and assembled to the developing frame, the electrode cover including:
  - a bearing plate having a developing roller shaft insertion hole for supporting the developing roller shaft; and
  - a coil support plate having an exposing hole, the contact coil of the coil electrode protruding through the exposing hole, the coil support plate including:
    - an extended plate extending from a surface of the coil support plate in the first direction; and a cylindrical protrusion protruding from a surface of the extended plate in a second direction perpendicular to the first direction, the urging coil of the coil electrode being fitted with the cylindrical protrusion.

14. The developing cartridge according to claim 13, wherein the coil support plate of the electrode cover further has an engagement groove, and wherein the coil electrode further includes:

an arm extending in the first direction and connecting the urging coil; and an engagement arm extending from an end of the arm and inserted into the engagement groove of the electrode cover.

15. The developing cartridge according to claim 14, wherein the engagement arm of the coil electrode has a L-shape.

16. The developing cartridge according to claim 15, wherein the engagement arm of the coil electrode includes a first portion bent from an end of the arm and a second portion bent from an end of the first portion, the second portion being parallel to the arm.

17. The developing cartridge according to claim 13, wherein the coil support plate of the electrode cover further includes crush ribs extending in a second direction, the crush ribs contacting the connecting arm.

18. The developing cartridge according to claim 13, wherein the coil support plate of the electrode cover further has a screw insertion hole through which a screw is inserted.

* * * * *